US010610036B1

(12) United States Patent
Witters

(10) Patent No.: US 10,610,036 B1
(45) Date of Patent: Apr. 7, 2020

(54) CONTAINER HOLDER OR COOLER, SYSTEM, AND ELECTRONIC DEVICE AND METHOD FOR LOCATING THE CONTAINER HOLDER OR COOLER

(71) Applicant: Steve Witters, Lagrange, KY (US)

(72) Inventor: Steve Witters, Lagrange, KY (US)

( * ) Notice: Subject to any disclaimer, the term of this patent is extended or adjusted under 35 U.S.C. 154(b) by 0 days.

(21) Appl. No.: 16/401,316

(22) Filed: May 2, 2019

(51) Int. Cl.
*A47G 23/02* (2006.01)
*B65D 81/38* (2006.01)
*G08B 7/06* (2006.01)

(52) U.S. Cl.
CPC ..... *A47G 23/02* (2013.01); *B65D 81/3879* (2013.01); *G08B 7/06* (2013.01); *B65D 2203/10* (2013.01)

(58) Field of Classification Search
CPC ..... A47G 23/02; B65D 81/3879; B65D 2203/10; G08B 7/068; G08B 21/24
USPC ..... 340/539.1
See application file for complete search history.

(56) References Cited

U.S. PATENT DOCUMENTS 4,886,183 A * 12/1989 Fleming ..... A47G 23/0266 220/739
5,969,592 A * 10/1999 Reed ..... A47G 23/0216 206/459.1
6,530,232 B1 * 3/2003 Kitchens ..... F25D 31/007 62/3.2
9,245,430 B1 * 1/2016 Berg ..... G08B 21/24
9,795,233 B2 * 10/2017 Brown ..... G09F 23/04
2002/0180601 A1 * 12/2002 Street ..... G08B 21/0216 340/568.1
2003/0210141 A1 * 11/2003 Iacovino ..... B65D 81/3879 340/539.1
2006/0219858 A1 * 10/2006 Iacovino ..... A47G 23/02 248/311.2
2007/0068944 A1 * 3/2007 McKinney ..... A45C 1/08 220/256.1
2008/0053109 A1 * 3/2008 Quincy ..... F25D 5/02 62/4

* cited by examiner

*Primary Examiner* — John A Tweel, Jr.
(74) *Attorney, Agent, or Firm* — Witters & Associates

(57) ABSTRACT

A locatable container holder or cooler having a wireless interconnection device is presently provided. At least one reporter such as a buzzer or light is held with the container holder or cooler and is in electrical communication with the wireless interconnection device. The wireless interconnection device is configured to wirelessly connect with a portable electronic device and report the location of the container holder or cooler by energizing the at least one reporter, upon receiving a location report command from the portable electronic device. A system and an electronic device and method for locating a container holder or cooler are also provided.

18 Claims, 4 Drawing Sheets

CONTAINER HOLDER OR COOLER, SYSTEM, AND ELECTRONIC DEVICE AND METHOD FOR LOCATING THE CONTAINER HOLDER OR COOLER

FIELD OF THE DISCLOSURE

This invention generally relates to container holders or coolers, and more particularly, toward a locatable container holder or cooler, an electronic device, system, and method for locating the container holder or cooler.

BACKGROUND

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Container holders or coolers are commonly used to hold beverage containers such as cans and bottles. Container holders or coolers are typically made of an insulating material such as foam, neoprene, or other insulating or polymeric material.

Electronic wireless systems for communication between electronic devices are in common use today. For example, portable electronic devices such as phones may have a variety of electronic wireless systems such as 3g, 4g, 4g LTE, WiFi, and Bluetooth®.

It may be desired to provide a container holder or cooler having an electronic wireless communication device for locating the container holder or cooler.

SUMMARY

In at least one aspect of the present disclosure, a container holder or cooler comprises a wireless interconnection device, at least one reporter in electrical communication with the wireless interconnection device, an antenna in electrical communication with the wireless interconnection device, and a power supply in electrical communication with the wireless interconnection device. The wireless interconnection device is configured to wirelessly connect with a portable electronic device and report the location of the container holder or cooler upon receiving a command from the portable electronic device.

In at least one other aspect of the present disclosure, a method of locating a container holder or cooler is provided. The method comprises wirelessly connecting a portable electronic device with a wireless interconnection device held with the container holder or cooler, sending a command from the portable electronic device to the wireless interconnection device held with the container or cooler, receiving the command sent by the portable electronic device with the wireless interconnection device held with the container or cooler; and reporting the location of the container holder or cooler with the wireless interconnection device, upon receiving the command from the portable electronic device.

In at least one additional aspect of the present disclosure, a system for locating a container holder or cooler is provided. The system comprises a portable electronic device being configured to send a wireless command upon being directed to send the command, a container holder or cooler, a wireless interconnection device held with the container holder or cooler, at least one reporter held with the container holder or cooler and in electrical communication with the wireless interconnection device, an antenna held with the container holder or cooler and in electrical communication with the wireless interconnection device, and a power supply held with the container holder or cooler and in electrical communication with the wireless interconnection device. The wireless interconnection device is configured to wirelessly connect with the portable electronic device and report the location of the container holder or cooler upon receiving the command from the portable electronic device.

In at least one further aspect of the present disclosure, an electronic device adapted to be held on or in a sidewall of a container holder or cooler is provided. The electronic device is configured for the locating the container holder or cooler. The electronic device has a printed circuit board, a wireless interconnection device held with the printed circuit board, a battery in electrical communication with the wireless interconnection device, an antenna in electrical communication with the wireless interconnection device, and at least one of a buzzer and a light held with the printed circuit board and in electrical communication with the wireless interconnection device. The wireless interconnection device is configured to wirelessly connect with a portable electronic device and energize the at least one of the buzzer and the light upon receiving a command from the portable electronic device.

BRIEF DESCRIPTIONS OF THE DRAWINGS

The following figures, which are idealized, are not to scale and are intended to be merely illustrative of aspects of the present disclosure and non-limiting. In the drawings, like elements may be depicted by like reference numerals. The drawings are briefly described as follows.

Figure 4:
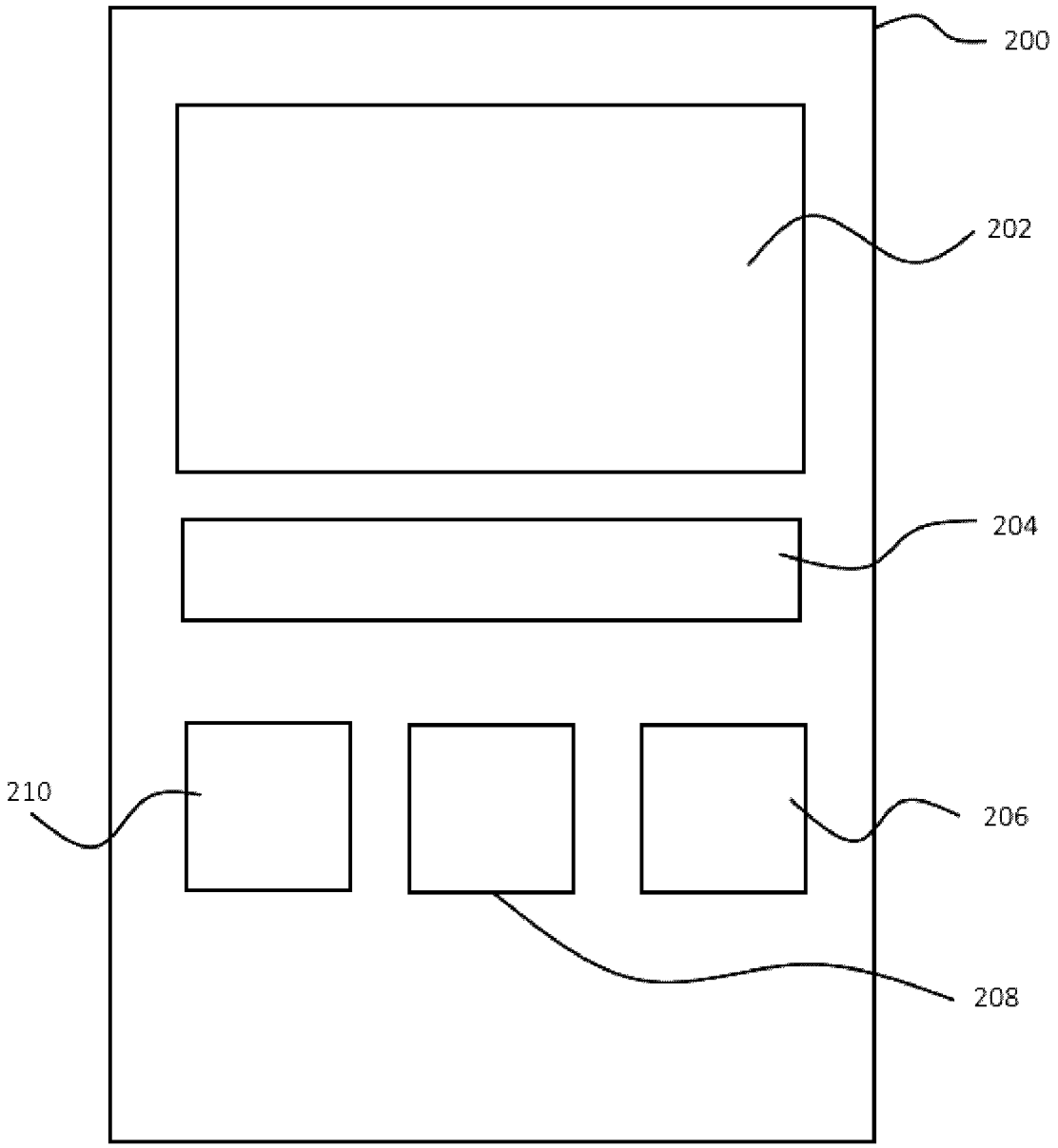
Figure 5A:
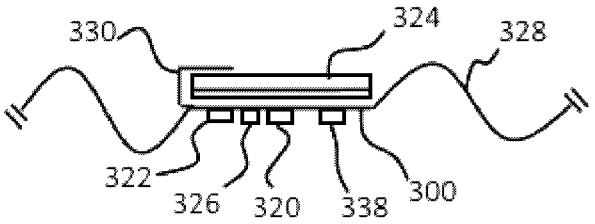
Figure 5B:
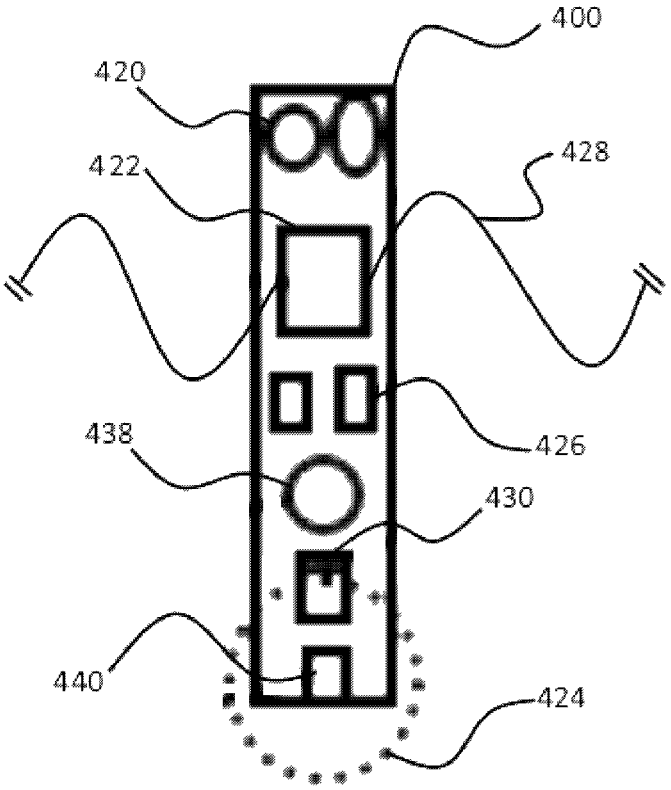

FIG. 4 schematically shows an illustrative example of a portable electronic device configured to send a command to the container holder or cooler of the present disclosure;

FIG. 5A illustratively shows an example electronic device of the present disclosure; and FIG. 5B illustratively shows another example electronic device of the present disclosure.

DETAILED DESCRIPTION

The presently disclosed container holder or cooler, method, and system provide a simple and fast way to locate a container. For example, if you misplace your drink held in the container holder or cooler, a tap of an icon on your phone or other portable electronic device may cause the container holder to light, buzz, or both. Sensors may be placed in the container holder or cooler. For example, a thermocouple or temperature sensor may enable the container holder or cooler to send a sensed temperature to the phone which may indicate that the drink is getting warm. Alternatively, or additionally, the container holder or cooler may be programmed to light or buzz when a set temperature is sensed, letting you know that the drink is getting warm. An accelerometer may be placed in the container holder or cooler. The accelerometer may enable the container holder or cooler to light and/or buzz upon movement of the container holder or cooler. Alternatively, or additionally, the accelerometer may send a signal to the phone to sound or otherwise indicate movement of the container holder or cooler.

The container holder or cooler may be configurable. For example, the notification of movement of the container holder or cooler may be turned on and off and a desired temperature may be set for notification of a sensed temperature.

Figure 1:
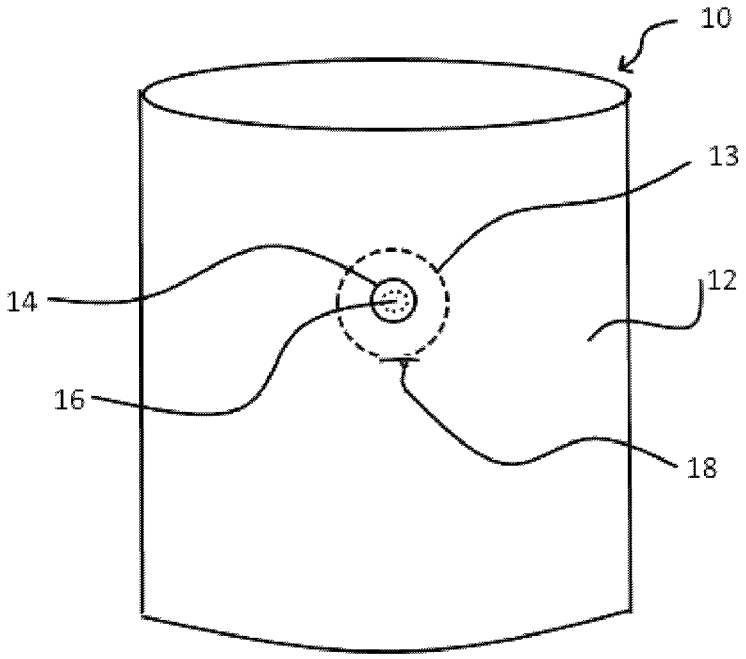
FIG. 1 is an illustrative view of the container holder or cooler of the present disclosure.

FIG. 1 shows an illustrative view of a container holder or cooler 10 of the present disclosure. Container holder or cooler 10 may have a sidewall 12 which may comprise an insulating material. For example, sidewall 12 may be comprised of a polymeric material such as foam. Sidewall 12 may be thin or thick. For example, sidewall 12 may have neoprene or may have a foam material, such as polyurethane foam. Sidewall 12 may be collapsible, flexible or foldable, or may have a rigid or semi-rigid structure.

Sidewall 12 may have a variety of shapes. For example, sidewall 12 may be cylindrical, or configured to fit around a cylindrical container, as may be desired for holding cylindrical containers such as cans. Sidewall 12 may be vertically curved or have a bell shape as may be desired for holding bottles. Container holder or cooler 10 may have a bottom wall extending inward from the bottom of sidewall 12. Container holder or cooler 10 or may have only a partial bottom wall which may ease collapsing of container holder or cooler 10. The configuration or materials of construction of container holder or cooler 10 may be that of any such shapes, configurations, or materials as are known by persons having ordinary skill in the art.

Container holder or cooler 10 has an opening 14 in its outer surface. Optionally, a slot 18 may be in sidewall 12. Slot 18 is optional and may extend completely through sidewall 12 or may extend in sidewall 12 to opening 14. For example, if sidewall 12 is thin, comprised of neoprene for example, slot 18 may not be provided or may extend from an inner surface of sidewall 12 to an outer surface of sidewall 12. Slot 18 may provide access to a battery held with sidewall 12. It is to be understood that battery access may not be needed or desired or a battery may be accessed from an inner surface of sidewall 12, making slot 18 unnecessary or undesirable.

In at least one embodiment sidewall 12 is thick and slot 18 may extend in sidewall 12 to opening 14. For example, slot 18 may provide a pocket 13 opening for inserting and holding electronic components in sidewall 12. In at least one embodiment, the electrical components and connections held with container holder or cooler 10 are in the form of a printed circuit board or PCB. The PCB may be circular or have a narrow stick like configuration wherein it may be inserted into slot 18 and dispose the reporter(s) 16 in opening 14. A vertical disposition of a longitudinally extending PCB may enable folding or bending of outer wall 12 and mitigate the folding or bending force on the PCB. The electronic components or electrical device may be held with, or held in, the container holder or cooler without a housing or additional structure or rigid structure. For example, the electrical components for reporting the location of the container holder or cooler may be held in or on sidewall 12 and the container holder or cooler may be void of a housing or other structural components for holding and/or protecting the electrical components.

Opening 14 provides an opening for at least one reporter 16 to be seen and/or heard. For example, reporter 16 may comprise, a light, a sounder, or both a light and a sounder. Opening 14 may provide a substantially unobstructed area for emitting light and/or sound from container holder or cooler 10. Opening 14 may also provide access to pocket 13 for inserting the electrical components or device into sidewall 12.

In at least one embodiment, opening 14 leads to a pocket 13 or cut area in sidewall 12 and sidewall 12 may be of a material that may be stretched to expand opening 14 for inserting the electrical components or device into the sidewall or pocket 13, making slot 18 unnecessary or undesirable.

Figure 2:
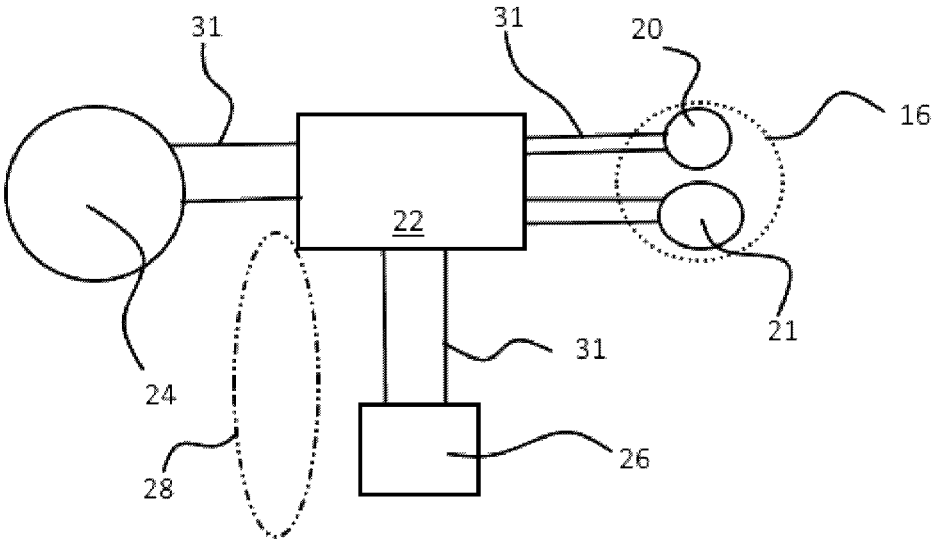
FIG. 2 is an illustrative schematic example of a wireless interconnection device and electronic components in electrical communication with the wireless interconnection device held with the container holder or cooler of the present disclosure.

FIG. 2 shows an illustrative schematic example of a wireless interconnection device and associated electrical connections and components of at least one embodiment of the presently disclosed container holder or cooler. In at least one embodiment, the container holder or cooler has a wireless interconnection device 22, at least one reporter 16 in electrical communication with wireless interconnection device 22, an antenna 28 in electrical communication with wireless interconnection device 22, and a power supply 24 in electrical communication with wireless interconnection device 22.

Wireless interconnection device 22 may be any wireless interconnection device as is known by persons having ordinary skill in the art for wirelessly connecting with a portable electronic device. For example, many portable electronic devices, such as phones, PDAs, pads, tablets, and portable computers, have at least one of WiFi, Bluetooth, and cellular wireless communication capabilities. Recently, Bluetooth® Low Energy (BLE) network technology is becoming used for wireless communication between electronic devices. BLE may provide a reduced power consumption and cost and may provide a similar communication range as Bluetooth®. In at least one embodiment of the present disclosure, wireless interconnection device 22 has BLE network capabilities. Wireless interconnection device 22 is configured to wirelessly connect with a portable electronic device and report the location of the container holder or cooler by energizing at least one reporter 16, upon receiving a location report command from the portable electronic device.

The container holder or cooler of the present disclosure may have at least one of a light 20 and a sounder 21 in electrical communication with wireless interconnection device 22. Light 20 may be an LED light and sounder 21 may be a piezoelectric buzzer. Reporter 16 may have both light 20 and sounder 21. In at least one embodiment, light 20 and sounder 21 may be placed in close proximity with each other, or even overlying each other, for placing in opening 14 in container holder or cooler 10.

The container holder or cooler of the present disclosure may have at least one sensor 26 in electrical communication with wireless interconnection device 22. For example, sensor 26 may be an accelerometer or movement sensor, thermocouple or temperature sensor, or other sensor known to persons having ordinary skill in the art. For example, sensor 26 may be one or more of a movement sensor, a temperature sensor, and a battery life sensor. One or more sensors 26 may be incorporated in wireless interconnection device 22. For example, wireless interconnection device 22 may be configured to sense a battery life and report when the charge of battery 24 is getting low.

Antenna 28 may be in electrical communication with wireless interconnection device 22. Antenna 28 may be configured for communication directly between the container holder or cooler and a portable electronic device, for example BLE. Antenna 28 may be configured for communication through existing wireless networks such as Wi-Fi or cellular networks.

Battery 24 may serve as a power supply for the presently disclosed container holder or cooler. Battery 24 may be a coin battery. Battery 24 may be rechargeable or disposable and may be configured to be removed from the container holder or cooler of the present disclosure.

Figure 3:
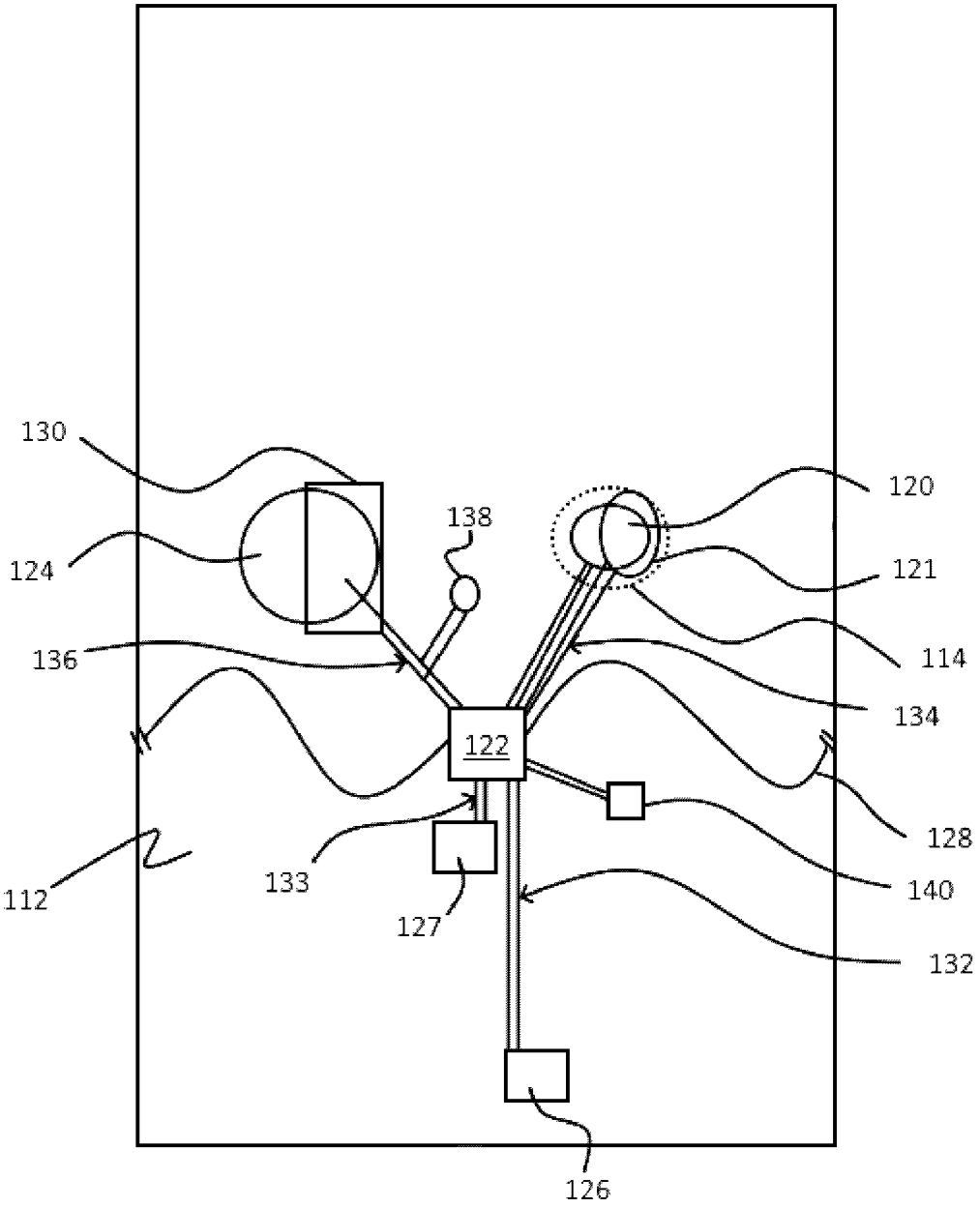
FIG. 3 is an illustrative view of a portion of an inside wall of the container holder or cooler of the present disclosure illustratively showing a schematic example of a wireless interconnection device and associated electrical components disposed thereon.

FIG. 3 is an illustrative view of a portion of an inside wall 112 of the container holder or cooler of the present disclosure schematically showing an example wireless interconnection device 122 disposed thereon. In at least one embodiment, the container holder or cooler has a wireless interconnection device 122 with at least one reporter, for example light 120 and/or sounder 121, in electrical communication with wireless interconnection device 122. Electrical communication may be made with electrical communication lines 134 which may be wires or electrical communication formed in a PCB. Light 120 and/or sounder 121 may be disposed in opening 114. In an embodiment having both light 120 and sounder 121, light 120 and sounder 121 may be placed adjacent one another or they may overlap as shown in FIG. 3.

An antenna 128 is in electrical communication with wireless interconnection device 122. Antenna 128 may extend from and about wireless interconnection device 122 or may extend completely around a perimeter of sidewall 112. Antenna 128 may have a length, material, or otherwise be designed for communicating at a desired wavelength, 2.4 GHz for example. A container held in the drink holder of cooler may shield portions of the antenna 128, therefore it may be preferred for antenna to extend completely around a circumference or perimeter of the container being held. In at least one embodiment, antenna 128 extends completely around a perimeter of the sidewall of the container holder or cooler of the present disclosure. Typical drink containers have a circumference between about 6 inches and about 10 inches. In an example wherein sidewall 112 is stretchable to tightly fit a container, neoprene for example, antenna 128 may need to change shape, or length about the perimeter of the container holder or cooler, to fit around containers of different sizes. Therefore, it may be advantageous for antenna 128 to have a length greater than a relaxed circumference of the container holder or cooler, for example a length up to about 10 inches. It may also be advantageous for antenna 128 to be disposed on or in sidewall 112 with a configuration that may mitigate breakage with the stretching of sidewall 112 to fit around a container. For example, antenna 128 may be disposed on sidewall 112 in a wave like configuration. It is to be understood that other and different configurations of antenna 128 are within the scope of the present application. For example, antenna 128 may have a length between about 6 to 10 inches, less than 6 inches, or in excess of 10 inches, in fractions of an inch.

Power supply 124 is in electrical communication with wireless interconnection device 122 with electrical communication lines 136. Power supply 124 may be a battery, for example a coin battery. Power supply 124 may be rechargeable or removable. For example, battery holder 130 may be configured to removeably hold power supply 124 and may provide electrical communication with wireless interconnection device 122 via electrical communication lines 136.

On/off switch 138 may be provided and configured to turn off power being supplied with power supply 124 when the container holder or cooler is not in use. In at least one embodiment of the present disclosure, on/off switch 138 is a bubble or button switch that may be switched on and off with the application of pressure to the outside surface of sidewall 112. An electrical connector, port, or plug 140 may be provided. For example, connector 140 may provide for the charging of power supply 124 and/or wired communication with wireless interconnection device 122. The electrical connector 140 may provide for wired programming or setting parameters, such as a sensed temperature for reporting, of wireless interconnection device 122.

The container holder or cooler of the present disclosure may have one or more sensors in electrical communication with wireless interconnection device 122. For example, sensor 126 may be a temperature sensor or thermocouple in electrical communication with wireless interconnection device 122 via connecting lines 132. Sensor 126 may be disposed on a lower portion of sidewall 112 which may detect a temperature of the contents of a container that is partially empty. Sensor 127 may be disposed on sidewall 112 and in electrical communication with wireless interconnection device 122 via connecting lines 133. Sensor 127 may be an accelerometer or movement sensor configured for sensing the movement of the container holder or cooler of the present disclosure. Other and different sensors may be incorporated with the container holder or cooler of the present disclosure. For example, a battery power level sensor may be provided which may be separate from, or as function of, wireless interconnection device 122.

As shown in FIG. 3, the electrical components of the present disclosure may be held on or in sidewall 112. For example, the electrical components may be adhered to an inner surface of sidewall 112, with an adhesive or tape for example, and have the at least one reporter, 120 and/or 121, aligned with opening 114. One or more electrical components and electrical connecting lines may be in a PCB which may be held in or on sidewall 112. For example, a PCB may be inserted into a pocket, such as pocket 13, in sidewall 112 or a PCB may be adhered to an inner surface of sidewall 112, with an adhesive or tape for example.

In at least one embodiment of the container holder or cooler of the present disclosure, a movement sensor is held in or on sidewall 112 and wireless interconnection 122 device is configured to energize at least one reporter, send a notification signal to a portable electronic device, or both, upon a sensed movement of the container holder or cooler. The reporting of movement may be turned on or off with the portable electronic device.

In at least one other embodiment of the container holder or cooler of the present disclosure, a temperature sensor is held in or on sidewall 112. For example, wireless interconnection 122 may be configured to send a temperature to a portable electronic device upon a receiving a command from the portable electronic device for reporting the location of the container holder or cooler or receiving a command for just reporting temperature. Wireless interconnection device 122 may be configured with a set temperature for energizing the at least one reporter, 120 and/or 121, upon a sensed temperature reaching the set temperature, send a temperature signal to the portable electronic device, or both. In at least one additional embodiment, wireless interconnection 122 may be configured to just locally report, by lighting a light and/or energizing a sounder, upon a sensed temperature reaching a set temperature.

Wireless interconnection device 122 may be configured to be programmed to carry out desired functions. For example, many BLE devices may be flashed with software for performing desired functions. Connector 140 may provide for charging of power supply 124 and may provide a wired connection of wireless interconnection device 122 with a computer for setting or programming. For example, the container holder or cooler of the present disclosure may be configured to send a signal to a portable electronic device, report locally with light and/or sound, or both, upon movement of the container or upon a sensed temperature reaching a set temperature.

FIG. 4 schematically shows an illustrative example of a portable electronic device 200 configured to send a command to the container holder or cooler of the present disclosure. Portable electronic device 200 may be a phone, pad, tablet, or other portable electronic device having wireless communication capabilities. Portable electronic device 200 may be configured with an application program, or app, that provides wireless communication with wireless interconnection device 122 or 22. In at least one embodiment, portable electronic device 200 may be wirelessly paired via BLE with the wireless interconnection device. Portable electronic device 200 may be configured to automatically wirelessly connect or pair with the wireless interconnection device upon initiation of an application on portable electronic device 200.

The application may configure portable electronic device 200 with a variety of control buttons, icons, set buttons, and display windows. In at least one embodiment, portable electronic device 200 is configured to wirelessly command, set, or program the wireless interconnection device held with the container holder or cooler. For example, control button or icon 202 may be configured to send a command, upon touching button or icon 202, to the container holder or cooler to report its location. Portable electronic device 200 and/or the wireless interconnection device may be configured to report the location for a set period of time or for the time period which button or icon 202 is touched or held. For example, the wireless interconnection device may be set to flash at least one reporter upon touching or holding icon 202.

Window 204 may be configured to display information received from the container holder or cooler of the present disclosure. For example, a sensed temperature, movement, battery life, or other information may be sent from the wireless interconnection device to portable electronic device 200 and displayed in window 204. The wireless interconnection device may be configured to automatically send information to portable electronic device 200 for display upon receiving a command to report its location.

Portable electronic device 200 may be configured to set parameters or control functions of a system for locating a container holder or cooler having a wireless interconnection device. For example, icon 210 may be configured to toggle on and off the sensing or reporting of movement of the container holder or cooler. In another example, icon 208 may be configured to set a temperature for reporting a notice that the sensed temperature is proximate or equal to the set temperature. In further example, icon 206 may be configured to set reporting parameters. For example, reporting of movement of the container holder or cooler may be turned off, set to report locally only with the reporter(s) held with the container holder or cooler, set to only send a signal to the portable electronic device, or set to energize the reporter(s) held with the container holder or cooler and to send a signal to the portable electronic device.

It is to be understood that portable electronic device 200 may have a variety of functions and configurations. For example, portable electronic device may have a sole window 202 for solely sending a command to the container holder or cooler to report its location.

FIGS. 5A and 5B illustratively show example electronic devices of the present disclosure. In at least one embodiment of the present disclosure, many of the electronic components and electrical connections that are held with the container holder or cooler are disposed in a PCB. The PCB may have a variety of configurations. For example, PCB 300 may be circular or angular. In at least one embodiment, PCB 300 is circular. For example, PCB 300 may have an outer perimeter proximate to that of the outer perimeter of a coin battery 324. Disposing coin battery 324 on a circular PCB 300 may protect PCB 300 from forces that may be exerted with bending, folding, or deforming the container holder or cooler holding PCB 300. In at least one embodiment, the electronic device is held on or in a container holder or cooler void of a housing or other structural features for protecting the electronic components.

In at least one embodiment of the present disclosure, PCB 300 has an outer perimeter proximate to an outer perimeter of battery 324. A battery connector or clip 330, wire or other electrical connector, may extend about a first side of PCB 300 and PCB 300 may be configured to electrically connect with battery 324 upon placement on PCB 300. A wireless interconnection device 322 may be held on a second side of PCB 300 and in electrical communication with battery 324. At least one reporter 320, a buzzer or light for example, may be held on PCB 300 and in electrical communication with wireless interconnection device 322. An on/off switch 338 may be held on PCB 300 and configured to turn the power from battery 324 on and off. Optionally, one or more sensors 326 may be held on PCB 300 and in electrical communication with wireless interconnection device 322. Antenna 328 may be formed in PCB 300 or may extend thereform. In at least one embodiment, antenna 328 has a length sufficient to completely extend around a perimeter of the container holder or cooler of the present disclosure.

Upon placement of battery 324 on PCB 300, a button like configuration of the presently disclosed electronic device is provided. The formed button may be placed in or behind opening 14 and be disposed to have at least one reporter 320 aligned with opening 14. For example, in a thick walled embodiment of container holder or cooler 10, opening 14 may not extend completely through sidewall 12 and may widen or have a pocket 13 within sidewall 12. A flexible sidewall may enable expansion of opening 14 for receiving PCB 300 and battery 324 into pocket 13. The walls of the pocket may hold battery 324 in electrical communication with PCB 300. In a thin walled embodiment of container holder or cooler 10, PCB 300 may be adhered to an inner surface of sidewall 12, with an adhesive or tape for example. Slot 18 may not need be provided for insertion of PCB 300 and battery 324 into sidewall 12 or adherence of PCB 300 and battery 324 to sidewall 12. No additional protection or housing may be needed to protect PCB 300.

The PCB may have a longitudinal rectangular or stick like configuration which may allow the container holder or cooler to change shape about its perimeter and mitigate force being applied to the PCB. For example, PCB 400, shown in FIG. 5B, may have electrical interface or plug 440, battery 424, on/off switch 438, sensor(s) 426, wireless interconnection device 422, and at least one reporter 420 on a longitudinally extending PCB 400 or aligned on a stick like configured PCB 400. Battery 424 may be removably held with battery holder 430. Antenna 428 may be formed in PCB 400 or may extend from PCB 400. For example, antenna 428 may be configured to extend completely around an inner perimeter of a sidewall of the presently disclosed container holder or cooler.

Referencing FIG. 1, a circular or stick PCB 400 may be held in pocket 13 or on an inner surface of sidewall 12. Optionally, battery 424 may be accessible through slot 18. At least one reporter 420 may be aligned with opening 14. PCB 400 may be configured to be easily installed into or on container holders or coolers on the market today. For example, a thick walled container may be configured to have a pocket or slit which may be formed by extending slot 18 in sidewall 12 to opening 14. A stick PCB may simply be slid into slot 18 and the at least one reporter 420 may be aligned with opening 14. Battery 424 may be accessible through slot 18. Installation of PCB 400 with a thin walled container may be performed by simply adhering PCB 400 to an inner surface of sidewall 12, with tape or glue for example.

In at least one embodiment of the present disclosure, an electronic device is adapted to be held on or in sidewall 12 of container holder or cooler 10 and is configured for the locating container holder or cooler 10. The electronic device has a longitudinally extending printed circuit board 400 having a longitudinal axis. Battery 424 is held with longitudinally extending printed circuit board. Wireless interconnection device 422 is held with longitudinally extending printed circuit board 400 and is in electrical communication with battery 424. Antenna 428 is in electrical communication with wireless interconnection device 422. At least one of a buzzer and a light 420 is held with longitudinally extending printed circuit board 400 and is in electrical communication with wireless interconnection device 422. Wireless interconnection device 422 is configured to wirelessly connect with a portable electronic device and energize the at least one of the buzzer and the light 420 upon receiving a command from the portable electronic device. Battery 424 is held proximate a first end of the longitudinal axis of printed circuit board 400, at least one of the buzzer and the light 420 is held on the printed circuit board a first distance from the first end, and wireless interconnection device 422 is held on the printed circuit board a second distance from the first end, the first distance being different than the second distance.

In at least one other embodiment of the present disclosure, antenna 428 extends from printed circuit board 400 and has a length sufficient for extending completely around a perimeter of sidewall 12 of container holder or cooler 10.

In at least one further embodiment, one or more of a)-e) are held with printed circuit board, wherein a)-e) are: a) a temperature sensor 326 in electrical communication with wireless interconnection device 422; b) a motion sensor 326 in electrical communication with wireless interconnection device 422; c) both the buzzer and the light; d) a battery holder 330 configured to removably hold battery 324 to printed circuit board 300; and e) an electronic communication port or plug 440.

A system for locating a container holder or cooler is presently provided. The system has a portable electronic device configured to send a wireless command upon being directed to send the command. A container holder or cooler has a wireless interconnection device held with the container holder or cooler. At least one reporter, a light or buzzer for example, is held with the container holder or cooler and is in electrical communication with the wireless interconnection device. An antenna is held with the container holder or cooler and is in electrical communication with the wireless interconnection device. A power supply is held with the container holder or cooler and is in electrical communication with the wireless interconnection device. The wireless interconnection device is configured to wirelessly connect with the portable electronic device and report the location of the container holder or cooler upon receiving the command from the portable electronic device. Reporting may be achieved by lighting a light, sounding a buzzer, or both.

The system for locating a container holder or cooler may be configured to wirelessly report information from the container holder or cooler and to the portable electronic device, which may be configured to receive the information reported by the wireless interconnection device.

The system for locating a container holder or cooler may have one or more sensors held with the container holder or cooler. The wireless interconnection device may be configured to wirelessly report sensed information to the portable electronic device, energize the at least one reporter, or both.

Presently disclosed is a method of locating a container holder or cooler. A container holder or cooler may be wirelessly connected with a portable electronic device with a wireless interconnection device held with the container holder or cooler. A command may be sent from the portable electronic device to the wireless interconnection device held with the container or cooler. Upon receiving the command sent by the portable electronic device with the wireless interconnection device, at least one reporter (ex. light or buzzer) is energized and the location of the container holder or cooler may be ascertained. In at least one embodiment, the step of energizing at least one reporter comprises emitting at least one of a light and a sound from the container holder or cooler.

The method of locating a container holder or cooler may optionally include sensing at least one of a temperature, a movement, and a battery life. The at least one reporter may be energized, a signal may be sent to the portable electronic device, or both, in response to the sensed temperature, movement, or battery life.

One or more operational parameters of the wireless interconnection device may be set with the portable electronic device. For example, sensing, or reporting of the sensing, may be turned on or off, set to locally report only by energizing at least one reporter, set to only send a signal to the portable electronic device, or set to both energize locally and send a signal to the portable electronic device The method of locating a container holder or cooler may include setting at least one operational parameter such as setting a temperature. For example, the system may be configured for energizing at least one reporter on the container holder or cooler, sending a signal from the wireless interconnection device to the portable electronic device, or both, upon a sensed temperature reaching the set temperature. A temperature may be set wirelessly with a portable electronic device or with a wired connection to electrical interface 440.

The system of present disclosure may be configured for sensing movement of the container holder or cooler and energizing at least one reporter on the container holder or cooler, sending a signal to the portable electronic device, or both, in response to a sensed movement of the container holder or cooler.

The invention claimed is:

1. A container holder or cooler comprising:

a wireless interconnection device;

at least one reporter in electrical communication with the wireless interconnection device;

an antenna extending completely around a perimeter of the container holder or cooler and in electrical communication with the wireless interconnection device;

a power supply in electrical communication with the wireless interconnection device; and wherein the wireless interconnection device is configured to wirelessly connect with a portable electronic device and report the location of the container holder or cooler by energizing the at least one reporter, upon receiving a location report command from the portable electronic device.

2. The container holder or cooler of claim 1, wherein the at least one reporter comprises at least one of a light and a sounder.

3. The container holder or cooler of claim 1 further comprising at least one sensor in electrical communication with the wireless interconnection device.

4. The container holder or cooler of claim 3, wherein the at least one sensor is selected from the group consisting of a movement sensor, a temperature sensor, and a battery life sensor.

5. The container holder or cooler of claim 3 comprising a movement sensor, wherein the wireless interconnection device is configured to energize the at least one reporter, send a notification signal to the portable electronic device, or both, upon the sensed movement of the container holder or cooler.

6. The container holder or cooler of claim 3 comprising a temperature sensor, wherein the wireless interconnection device is configured to send the temperature signal to the portable electronic device, upon receiving the location report command or a temperature sensing command, from the portable electronic device.

7. The container holder or cooler of claim 6, wherein the wireless interconnection device is configured to compare a sensed temperature with a set temperature and energize the at least one reporter, send a temperature signal to the portable electronic device, or both, upon the sensed temperature reaching the set temperature.

8. A method of locating a container holder or cooler comprising the steps of:

wirelessly connecting a portable electronic device with a wireless interconnection device held with the container holder or cooler;

setting at least one operational parameter of the wireless interconnection device, with the portable electronic device;

sending a command from the portable electronic device to the wireless interconnection device held with the container or cooler;

receiving the command sent by the portable electronic device with the wireless interconnection device held with the container or cooler; and energizing at least one reporter and thereby reporting the location of the container holder or cooler, with the wireless interconnection device upon receiving the command from the portable electronic device.

9. The method of locating a container holder or cooler of claim 8, wherein the step of energizing at least one reporter comprises emitting at least one of a light and a sound from the container holder or cooler.

10. The method of locating a container holder or cooler of claim 8 further comprising a step of sensing at least one of a temperature, a movement, and a battery life.

11. The method of locating a container holder or cooler of claim 10 further comprising a step of energizing the at least one reporter, sending a signal to the portable electronic device, or both, in response to the sensed temperature, movement, or battery life.

12. The method of locating a container holder or cooler of claim 8, wherein the step of setting at least one operational parameter comprises turning on or off the sensing, or the reporting of the sensing.

13. The method of locating a container holder or cooler of claim 8, wherein the step of setting at least one operational parameter comprises setting a temperature.

14. The method of locating a container holder or cooler of claim 13 further comprising a step energizing the at least one reporter, sending a signal from the wireless interconnection device to the portable electronic device, or both, upon a sensed temperature reaching the set temperature.

15. The method of locating a container holder or cooler of claim 10 further comprising a step of energizing the at least one reporter, sending a signal to the portable electronic device, or both, in response to a sensed movement of the container holder or cooler.

16. An electronic device adapted to be held on or in a sidewall of a container holder or cooler and configured for the locating the container holder or cooler, the electronic device comprising:

a wireless interconnection device;

a battery held in electrical communication with the wireless interconnection device;

an antenna in electrical communication with the wireless interconnection device;

at least one of a buzzer and a light held in electrical communication with the wireless interconnection device; and wherein the wireless interconnection device is configured to wirelessly connect with a portable electronic device, report at least one operational parameter wirelessly to the portable electronic device, and energize the at least one of the buzzer and the light upon receiving a command from the portable electronic device.

17. The electronic device of claim 16 further comprising a printed circuit board, the wireless interconnection device being held with the printed circuit board, the battery being held electrical communication with the printed circuit board, the at least one of the buzzer and the light being held with the printed circuit board; and wherein the printed circuit board is configured to be held in or on the sidewall of the container holder or cooler.

18. The electronic device of claim 16 further comprising at least one of a)-g), wherein a)-g) are:

a) the antenna has a length for extending completely around a perimeter of the sidewall of the container holder or cooler;

b) a temperature sensor in electrical communication with the wireless interconnection device;

c) a motion sensor in electrical communication with the wireless interconnection device;

d) the buzzer and the light;

e) a battery holder configured to removably hold the battery in electrical communication with the wireless interconnection device;

f) an electronic communication port or plug in electrical communication with the wireless interconnection device;

g) a circular printed circuit board; and h) a longitudinally extending printed circuit board having a longitudinal axis.

* * * * *